US011173731B2

(12) United States Patent
Ooi et al.

(10) Patent No.: US 11,173,731 B2
(45) Date of Patent: Nov. 16, 2021

(54) PRINTER AND METHOD

(71) Applicant: TOSHIBA TEC KABUSHIKI KAISHA, Tokyo (JP)

(72) Inventors: Steve Ooi, Singapore (SG); Noriyuki Watanabe, Mishima Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 345 days.

(21) Appl. No.: 16/195,906

(22) Filed: Nov. 20, 2018

(65) Prior Publication Data

US 2019/0176495 A1 Jun. 13, 2019

(30) Foreign Application Priority Data

Dec. 8, 2017 (JP) ..... JP2017-236386

(51) Int. Cl.
*B41J 11/70* (2006.01)
*B41J 11/68* (2006.01)
(Continued)

(52) U.S. Cl.
CPC ..... *B41J 11/68* (2013.01); *B41J 2/32* (2013.01); *B41J 3/36* (2013.01); *B41J 11/04* (2013.01);
(Continued)

(58) Field of Classification Search
CPC ..... B41J 11/70
(Continued)

(56) References Cited

U.S. PATENT DOCUMENTS 8,090,308 B2 * 1/2012 Itoh ..... B65H 26/06 399/385
8,622,640 B2 * 1/2014 Sato ..... B41J 11/70 400/621
(Continued)

FOREIGN PATENT DOCUMENTS

JP 10-198865 7/1998
JP 2004-090280 3/2004
(Continued)

OTHER PUBLICATIONS

Extended European Search Report for European Patent Application No. 18210360.6 dated May 13, 2019.
(Continued)

*Primary Examiner* — Anthony H Nguyen
(74) *Attorney, Agent, or Firm* — Amin, Turocy & Watson, LLP

(57) ABSTRACT

According to one embodiment, a printer and a method can print information printed as a header without a reduction even when a gap from a printing head to a cutting unit is short. The printer includes the printing head, the cutting unit, an input unit, a storage control unit, a first printing control unit, a cutting control unit, and a second printing control unit. The printing head performs printing on a roll paper. The cutting unit is disposed on a downstream side in a conveyance direction of the roll paper from the printing head, and cuts the roll paper. The input unit receives an input of printing information. The storage control unit stores the printing information. The first printing control unit prints the printing information if a length in the conveyance direction of the stored printing information is equal to or more than a setting value. When receiving a cut request, the cutting control unit performs cutting if the length in the conveyance direction of the printing information is the setting value. The
(Continued)

second printing control unit prints the printing information if the roll paper is cut.

20 Claims, 5 Drawing Sheets

(51) Int. Cl.

| | |
|---|---|
| ***B41J 29/38*** | (2006.01) |
| ***B41J 11/04*** | (2006.01) |
| ***B41J 3/36*** | (2006.01) |
| ***B41J 2/32*** | (2006.01) |
| ***B41J 11/66*** | (2006.01) |
| ***B41J 11/48*** | (2006.01) |
| *B41J 2/01* | (2006.01) |

(52) U.S. Cl.
CPC ..... *B41J 11/48* (2013.01); *B41J 11/663* (2013.01); *B41J 11/70* (2013.01); *B41J 29/38* (2013.01); *B41J 2/01* (2013.01)

(58) Field of Classification Search
USPC ..... 400/621
See application file for complete search history.

(56) References Cited

U.S. PATENT DOCUMENTS

| | | | | |
|---|---|---|---|---|
| 9,290,022 | B2 | 3/2016 | Makabe | |
| 9,387,693 | B2 | 7/2016 | Kobayashi | |
| 2009/0285617 | A1* | 11/2009 | Vandermeulen | B41J 11/666 400/621 |
| 2012/0042760 | A1* | 2/2012 | Mitsuhashi | B41J 11/46 83/72 |
| 2013/0003097 | A1* | 1/2013 | Yokoyama | G06K 15/1822 358/1.13 |
| 2013/0078024 | A1* | 3/2013 | Handa | B41J 3/4075 400/621 |
| 2013/0242316 | A1* | 9/2013 | Iwata | G06K 15/404 358/1.5 |
| 2014/0253659 | A1 | 9/2014 | Inaba | |

FOREIGN PATENT DOCUMENTS

| | | |
|---|---|---|
| JP | 2004-216692 | 8/2004 |
| JP | 2007-047898 | 2/2007 |
| JP | 2009-297984 | 12/2009 |

OTHER PUBLICATIONS

Chinese Office Action for Chinese Patent Application No. 201811487775.0 dated May 7, 2020.

Japanese Office Action for Japanese Patent Application No. 2017-236386 dated Jun. 29, 2021.

* cited by examiner

PRINTER AND METHOD

CROSS-REFERENCE TO RELATED APPLICATIONS

This application is based upon and claims the benefit of priority from Japanese Patent Application No. 2017-236386, filed in Dec. 8, 2017, the entire contents of which are incorporated herein by reference.

FIELD

Embodiments described herein relate generally to a printer and a method of printing.

BACKGROUND

There is known a printer which cuts a roll paper wound in a roll shape to issue each printed material. Such a printer includes a cutting unit which cuts the roll paper on a downstream side in a conveyance direction of the roll paper from a printing head which prints various types of information in the roll paper. Therefore, the printer conveys a terminated end of a portion printed by the printing head up to the position of the cutting unit, and cuts the roll paper.

In the conveyance for matching the terminated end, if nothing is printed on the roll paper, the printed material having a margin is issued. Then, the printer prints various types of information as a header of the next printed material in the margin part. However, since the margin part is originally unnecessary, a printer is developed which can shorten a gap between the printing head and the cutting unit.

However, if the gap between the printing head and the cutting unit is shortened, the margin part is also shortened. Therefore, the printer has to reduce various types of information printed as the header.

DETAILED DESCRIPTION

An exemplary embodiment provides a printer and a method which can print information printed as a header without causing a contraction even when a gap from a printing head to a cutting unit is short.

In general, according to one embodiment, a printer includes a printing head, a cutting unit, a first input unit, a storage control unit, a first printing control unit, a cutting control unit, and a second printing control unit. The printing head performs printing on a roll paper which is wound in a roll shape. The cutting unit is disposed on a downstream side of a conveyance direction of the roll paper from the printing head, and cuts the roll paper. The first input unit sequentially receives an input of printing information to be printed by the printing head. The storage control unit sequentially stores the printing information received by the first input unit to a storage medium. The first printing control unit causes the printing head to sequentially print the printing information of an excess portion stored in the storage medium on condition that a total sum of lengths in the conveyance direction of the respective pieces of the printing information stored in the storage medium is equal to or more than a setting value. If a cut request of the roll paper is received, the cutting control unit causes the cutting unit to cut the roll paper on condition that a total sum of lengths in the conveyance direction of the printing information which is stored in the storage medium but not printed is the setting value. The second printing control unit causes the printing head to print the printing information which is stored in the storage medium but not printed on condition that the cutting control unit causes the cutting unit to cut the roll paper.

Hereinafter, embodiments of a printer and a method will be described in detail with reference to the accompanying drawings. Further, the embodiments described below are the printer and the method, but the configurations and the specifications are not limited thereto. The printer and the method of the embodiments are applications of a printer which issues a printed material such as a receipt in which a transaction detail is printed.

Figure 1:
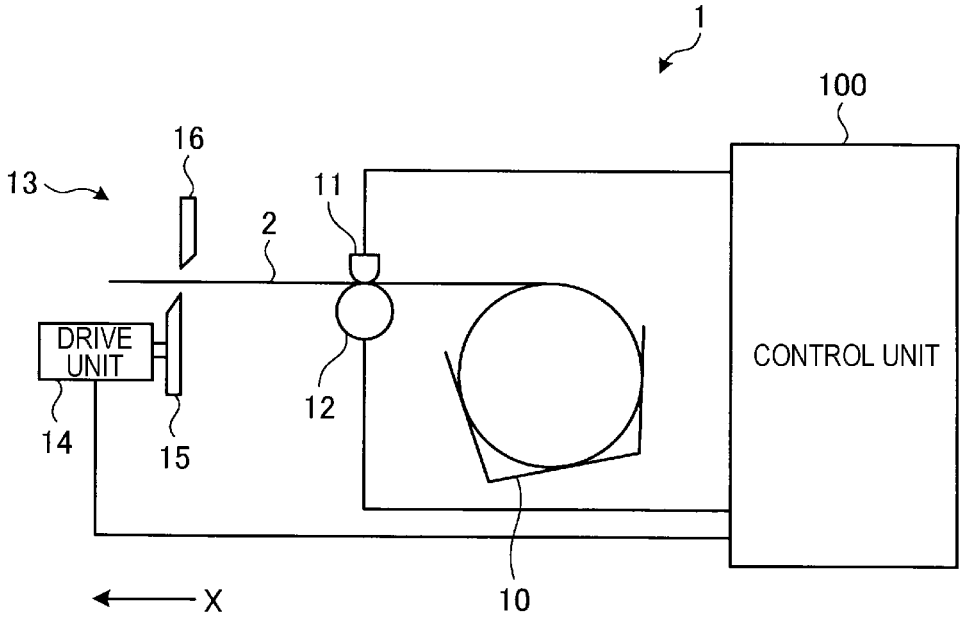
FIG. 1 is a diagram for describing an example of a schematic configuration of a printer.

FIG. 1 is a diagram for describing an example of a schematic configuration of a printer 1. The printer 1 receives information such as the receipt of a printing target from an external device such as a POS (Point of Sales) terminal. The printer 1 prints the information of the printing target in a roll paper 2 which is wound in a roll shape. Then, the printer 1 cuts the roll paper 2 if the cut request of the roll paper 2 is received. In this way, the printer 1 issues the printed material such as the receipt.

More specifically, the printer 1 includes a containing unit 10 which contains the roll paper 2 wound in a roll shape. The roll paper 2 drawn out of the containing unit 10 is interposed by a printing head 11 and a platen roller 12.

The printing head 11 is a thermal head which prints various types of information in a printing surface of the roll paper 2 by being heated for example. Further, the printing head 11 is not limited to the thermal head, but may be an inkjet head which discharges ink. The platen roller 12 rotates in a counterclockwise by a motor or the like to convey the roll paper 2 in an X direction. With such a configuration, the printing head 11 and the platen roller 12 convey the roll paper 2 while printing various types of information in the printing surface.

The printer 1 includes a cutting unit 13 which cuts the roll paper 2. The cutting unit 13 is disposed on the downstream side in the conveyance direction of the roll paper 2 from the printing head 11 and the platen roller 12. The cutting unit 13 includes a drive unit 14, a movable blade 15, and a fixed blade 16. The drive unit 14 is, for example, a motor. The drive unit 14 pushes up the movable blade 15. The movable blade 15 is pushed up by the drive unit 14 to be overlapped with the fixed blade 16. In this way, the movable blade 15 and the fixed blade 16 cut the roll paper 2.

In addition, the printer 1 includes a control unit 100 which controls the printing head 11, the platen roller 12, and the drive unit 14.

Figure 2:
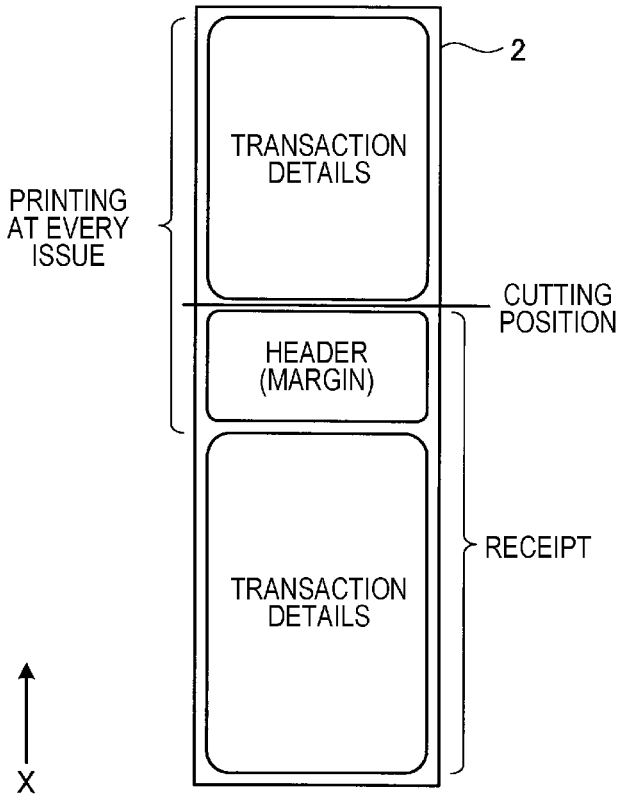
FIG. 2 is a diagram for describing an outline of a printing method of the printer.

Next, the outline of a printing operation of the printer will be described. Here, FIG. 2 is a diagram for schematically describing a printing method of the printer 1. The printer 1 includes the cutting unit 13 on the downstream side in the conveyance direction of the roll paper 2 from the printing head 11 and the platen roller 12. Therefore, when the printing of the transaction detail of the receipt is ended, and the printer 1 cuts the roll paper 2 without conveying the roll paper 2, the roll paper 2 is cut in the middle of the transaction detail. For this reason, the printer 1 cuts the roll paper 2 after conveying a terminated end of the transaction detail printed in the roll paper 2 up to a cutting position of the cutting unit 13.

If the roll paper 2 is printed with nothing in the conveyance, the printer 1 issues a receipt with the margin formed. Therefore, the printer 1 prints the header such as logos of a store in the margin as illustrated in FIG. 2. In other words, the printer 1 prints the transaction detail of the present issued receipt and the header of the sequentially issued receipt at one issue of the receipt. Then, the printer 1 cuts the roll paper 2 at the cutting position between the transaction detail and the header. In this way, the printer 1 issues each receipt.

By the way, the margin is preferably a short one. Therefore, a technique has been developed to shorten a gap from the printing head 11 and the platen roller 12 to the cutting unit 13. However, if the gap from the printing head 11 and the platen roller 12 to the cutting unit 13 is shortened, the printer 1 is not possible to print the existing header in the margin.

Figure 3A:
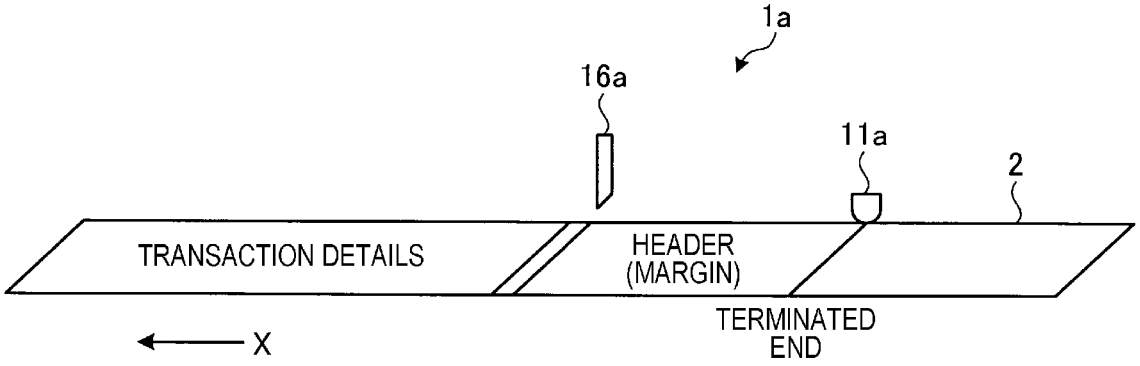
FIGS. 3A and 3B are diagrams for describing an event when a header is not possible to be printed in a margin.
Figure 3B:
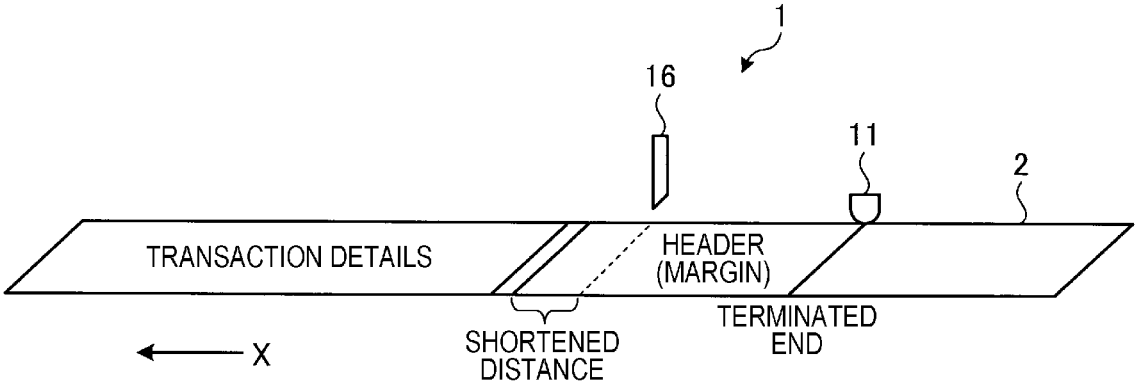

Next, a case where the printing of the header is not possible in the margin will be described. Here, FIGS. 3A and 3B are diagrams illustrating a case where the printing of the header is not possible in the margin. FIG. 3A is a diagram for describing the case of a printer 1*a* in which a gap from a printing head 11*a* to a fixed blade 16*a* is not shortened. FIG. 3B is a diagram for describing the case of the printer 1 in which the gap from the printing head 11 to the fixed blade 16 is shortened.

As illustrated in FIG. 3A, in the case of the printer 1*a*, the header is created in accordance with the gap from the printing head 11*a* to the fixed blade 16*a*. Therefore, the gap from the printing head 11*a* to the fixed blade 16*a* is almost the same as the length in the conveyance direction of the header. For this reason, the printer 1*a* can cut the roll paper 2 between the transaction detail and the header by cutting the roll paper 2 after the printing is made up to the terminated end of the header.

On the other hand, the printer 1 is configured such that the gap from the printing head 11 to the fixed blade 16 is shortened as illustrated in FIG. 3B. In addition, the header is not created in accordance with the gap from the printing head 11 to the fixed blade 16. In other words, in the case of the printer 1, the gap from the printing head 11 to the fixed blade 16 is shorter than the length in the conveyance direction of the header. Therefore, if the printing is performed up to the terminated end of the header, and the roll paper 2 is cut, the printer 1 comes to cut the roll paper 2 in the middle of the header. In this case, the printer 1 is not possible to issue a correct receipt.

Therefore, the printer 1 has a compatibility mode in which the existing header is printable even if the gap from the printing head 11 and the platen roller 12 to the cutting unit 13 becomes short.

Next, the compatibility mode will be described. The compatibility mode is a mode for printing a portion which is not possible to be printed after cutting the roll paper 2 because of shortening the gap from the printing head 11 and the platen roller 12 to the cutting unit 13. In this way, the printer 1 prevents the roll paper 2 from being cut in the middle of the header by printing the header as long as the shortened distance after cutting.

More specifically, if the printing information of the printing target is received from the external device in the compatibility mode, the printer 1 stores the printing information without performing the printing. In addition, the printer 1 determines whether a total sum of lengths when the stored printing information is printed is equal to or more than a setting value. The setting value is information indicating the same length as that in the conveyance direction of the roll paper 2 which indicates the shortened distance from the printing head 11 and the platen roller 12 to the cutting unit 13. In other words, the setting value is information indicating the length in the conveyance direction of the roll paper 2 which is printed and conveyed after cutting the roll paper 2 in the compatibility mode.

If the printing information equal to or more than the setting value is stored, the printer 1 prints the printing information of an excess portion while leaving the printing information equal to or more than the setting value in the stored printing information. Here, the external device divides the printed material into a plurality of blocks and sequentially transmits the printing information of the respective blocks instead of transmitting the printing information of the entire printed material at once. Then, the printer 1 repeatedly stores the received printing information and the prints the printing information of the excess portion.

Figure 4:
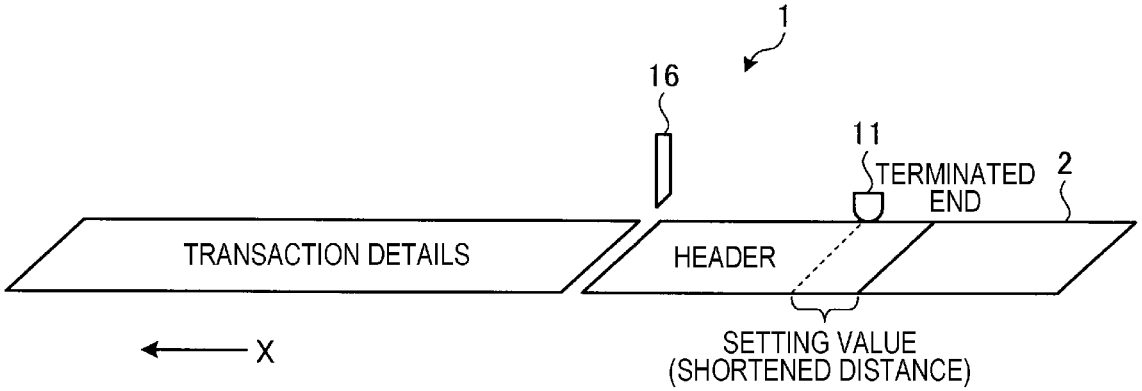
FIG. 4 is a diagram for describing a cut state of a roll paper in a compatibility mode.

If the cut request of the roll paper 2 is received from the external device, the printer 1 prints the printing information of the excess portion while leaving the printing information necessary for the printing of the length indicated by the setting value in the stored printing information. Here, FIG. 4 is a diagram for describing a cut state of the roll paper 2 in the compatibility mode. If the length when the unprinted printing information is printed in the roll paper 2 as illustrated in FIG. 4 becomes the setting value, the printer 1 cuts the roll paper 2. In addition, after cutting the roll paper 2, the printer 1 prints the unprinted printing information. In this way, the printer 1 cuts the roll paper 2 before the header reaches the terminated end, so that it is prevented that the roll paper 2 is cut in the middle of the header.

Next, a hardware configuration of the printer 1 will be described.

Figure 5:
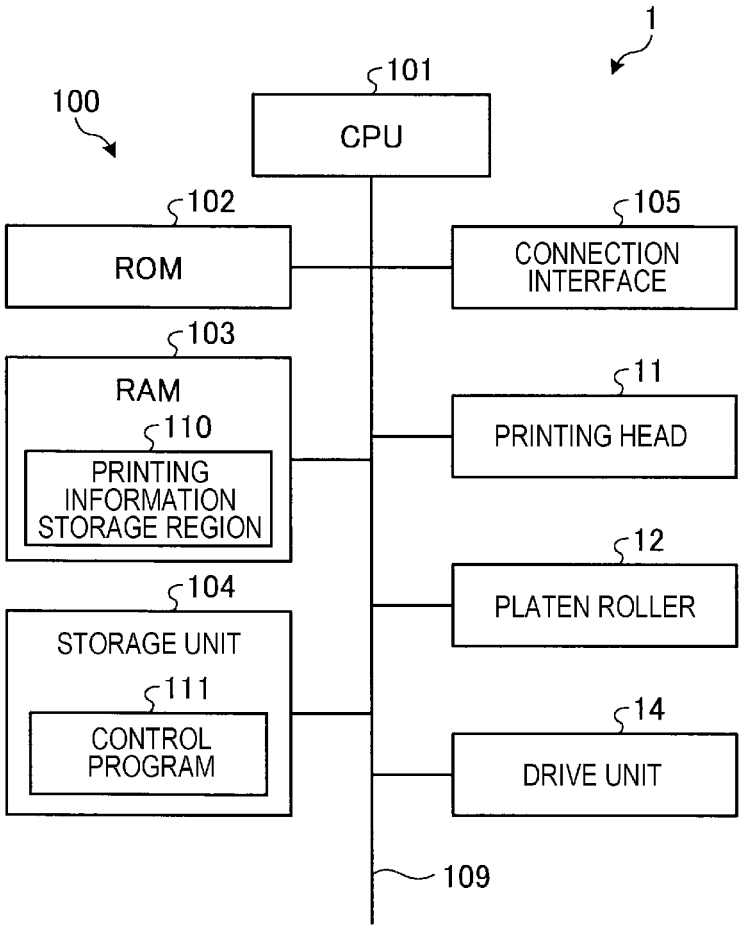
FIG. 5 is a block diagram illustrating an example of a hardware configuration of the printer.

FIG. 5 is a block diagram illustrating an example of the hardware configuration of the printer 1. The printer 1 includes the control unit 100, a storage unit 104, a connection interface 105, the printing head 11, the platen roller 12, and the drive unit 14. These components are connected to each other through a system bus 109 such as a data bus or an address bus.

The control unit 100 is a computer which controls the entire operation of the printer 1, and realizes various types of functions of the printer 1. The control unit 100 includes a CPU (Central Processing Unit) 101, a ROM (Read Only Memory) 102, and a RAM (Random Access Memory) 103. The CPU 101 integrally controls the operation of the printer 1. The ROM 102 is a storage medium which stores various types of programs and data. The RAM 103 is a storage medium which temporally stores various types of programs and various types of data. Then, the CPU 101 executes a program which is stored in the ROM 102 or the storage unit 104 using the RAM 103 as a work area.

The RAM 103 is used for a printing information recording region 110 which temporally stores the printing information received from a POS terminal. The printing information recording region 110 is an example of a storage medium. In the printing information recording region 110, the printing information is managed in a FIFO (First In First Out)

scheme. Further, the printing information is not limited to be stored in the RAM 103, but may be stored in the storage unit 104.

The storage unit 104 is a storage device such as an HDD (Hard Disk Drive) or an SSD (Solid State Drive). The storage unit 104 stores a control program 111. The control program 111 is an operating system or a program to realize the functions of the printer 1. The control program 111 includes a program which realizes a feature function related to this embodiment.

The connection interface 105 is an interface for connecting the external device such as the POS terminal. The connection interface 105 is, for example, an interface IC (Integrated Circuit).

Next, the featured function of the printer 1 will be described. Here, FIG. 6 is a block diagram illustrating an example of the featured functional configuration of the printer 1.

Figure 6:
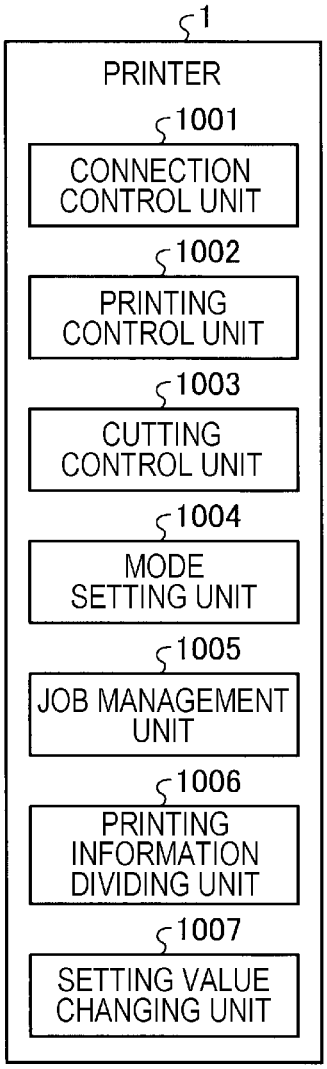
FIG. 6 is a block diagram illustrating an example of a featured functional configuration of the printer.

The CPU 101 of the printer 1 develops the control program 111 of the storage unit 104 in the RAM 103, and operates according to the control program 111 so as to generate the functional units illustrated in FIG. 6 on the RAM 103. Specifically, the control unit 100 of the printer 1 includes, as functional units, a connection control unit 1001, a printing control unit 1002, a cutting control unit 1003, a mode setting unit 1004, a job management unit 1005, a printing information dividing unit 1006, and a setting value changing unit 1007.

The connection control unit 1001 is an example of the first input unit, a second input unit, and a third input unit. The connection control unit 1001 controls the connection interface 105, and controls the communication with the external device such as the POS terminal. The connection control unit 1001 sequentially receives a print request which requests the printing to the roll paper 2 for example. The print request includes the printing information of a printing target. The printing information is image data of a raster format which is used to form an image by arranging a plurality of dots in a matrix shape for example. Then, the connection control unit 1001 receives the printing information of blocks divided in element unit of image data (printing target). For example, the connection control unit 1001 receives the printing information of the raster format of 1 row in the conveyance direction of the roll paper 2 when the corresponding block is a graph. In addition, the connection control unit 1001 receives the printing information of the raster format of 27 rows in the conveyance direction of the roll paper 2 when the corresponding block is a character. In addition, the connection control unit 1001 receives the cut request which requests the cutting of the roll paper 2 after receiving the final print request.

The printing control unit 1002 is an example of the first printing control unit and the second printing control unit. The printing control unit 1002 controls the printing head 11 and the platen roller 12 to print the printing information (printing target) in the roll paper 2.

The cutting control unit 1003 is an example of the cutting control unit. The cutting control unit 1003 controls the cutting unit 13 to cut the roll paper 2.

The mode setting unit 1004 sets a cutting condition of cutting the roll paper 2 to the compatibility mode or a normal mode. The compatibility mode is a mode for printing on the shortened distance after cutting the roll paper 2. The normal mode is a mode for cutting the roll paper 2 on condition that the printing is performed up to the terminated end of the printing information. The printer 1 can make the roll paper 2 used in the printing small by being set to the normal mode when the header information is reduced.

For example, when the connection control unit 1001 receives a mode changing request for changing the mode, the mode setting unit 1004 is set to a mode for setting the mode changing request. Further, the mode setting unit 1004 may be set to a predetermined mode when the mode changing request is received not only through the connection control unit 1001 but also through a network or when an operation of changing the mode is received.

The job management unit 1005 is an example of the storage control unit. The job management unit 1005 manages a job to be performed according to the print request or the cut request. The job management unit 1005 sequentially stores the printing information included in the received print request in the printing information recording region 110 when the connection control unit 1001 receives the print request. In addition, the job management unit 1005 extracts the printing information except the printing information lately stored in the printing information recording region 110 among the printing information stored in the printing information recording region 110. The job management unit 1005 determines whether a printing length indicating a total sum of lengths when the extracted printing information is respectively printed in the roll paper 2 is equal to or more than the setting value. The job management unit 1005 causes the printing control unit 1002 to sequentially print the printing information lately stored in the printing information recording region 110 on condition that the printing length is equal to or more than the setting value.

For example, the description will be given about an example that the setting value is 37 rows. In the printing information recording region 110, the printing information of Block A of 27 rows and Block B of 27 rows is stored. If the printing information of Block C of 27 rows is newly stored in the printing information recording region 110, the printing information of 54 rows of Block B and Block C is stored in the printing information recording region 110 even though Block A of 27 rows is excluded. In this case, the printing information of 37 or more rows of the setting value is stored in the printing information recording region 110. Therefore, the job management unit 1005 causes the printing control unit 1002 to print the printing information of Block A. Then, if Block B is excluded, the printing information of only 27 rows is stored in the printing information recording region 110. Therefore, the job management unit 1005 is on standby without printing. The job management unit 1005 repeatedly performs the above process until the connection control unit 1001 receives the cut request.

In addition, the job management unit 1005 causes the printing information dividing unit 1006 to divide the printing information stored in the printing information recording region 110 if the connection control unit 1001 receives the cut request. In other words, the job management unit 1005 divides the printing information stored in the printing information recording region 110 into the printing information to be printed before cutting and the printing information to be printed after cutting. The job management unit 1005 causes the printing control unit 1002 to print the printing information on the downstream side in the conveyance direction of the roll paper 2 in the divided printing information. With this configuration, the length in the conveyance direction when the printing information which is stored in the printing information recording region 110 but not printed is printed in the roll paper 2 becomes equal to the length indicated by the setting value.

Then, the job management unit 1005 causes the cutting control unit 1003 to cut the roll paper 2 if the printing is ended. The job management unit 1005 causes the printing control unit 1002 to print the unprinted printing information in the divided printing information. Further, if the printing length of the printing information stored in the printing information recording region 110 is equal to the setting value, the job management unit 1005 causes the cutting control unit 1003 to perform the cutting without causing the printing information dividing unit 1006 to perform the dividing. Then, the job management unit 1005 causes the printing control unit 1002 to print the unprinted printing information.

The printing information dividing unit 1006 is an example of a dividing unit. The printing information dividing unit 1006 divides the printing information stored in the printing information recording region 110 into the downstream side in the conveyance direction of the roll paper 2 and the upstream side in the conveyance direction by the boundary of the setting value according to the request of the job management unit 1005. Here, an example of a dividing process will be described. The setting value is assumed to be set with 37 rows. In the printing information recording region 110, Block B of 27 rows and Block C of 27 rows stored after Block B are stored. In this case, since the setting value is 37 rows, Block C alone is insufficient by 10 rows for the setting value. Therefore, the printing information dividing unit 1006 divides the printing information of Block B into the printing information of 17 rows of the downstream side in the conveyance direction of the roll paper 2 and the printing information of 10 rows of the upstream side in the conveyance direction of the roll paper 2.

In the compatibility mode, the setting value changing unit 1007 changes the setting value indicating the length in the conveyance direction of the roll paper 2 which is printed and conveyed the cut roll paper 2. For example, when the connection control unit 1001 receives a setting value change request for requesting the change of the setting value, the setting value changing unit 1007 changes the setting value designated by the setting value change request. Further, the setting value changing unit 1007 may set the designated setting value when the setting value change request is received not only through the connection control unit 1001 but also through a network, or when an operation for changing the setting value is received.

Figure 7:
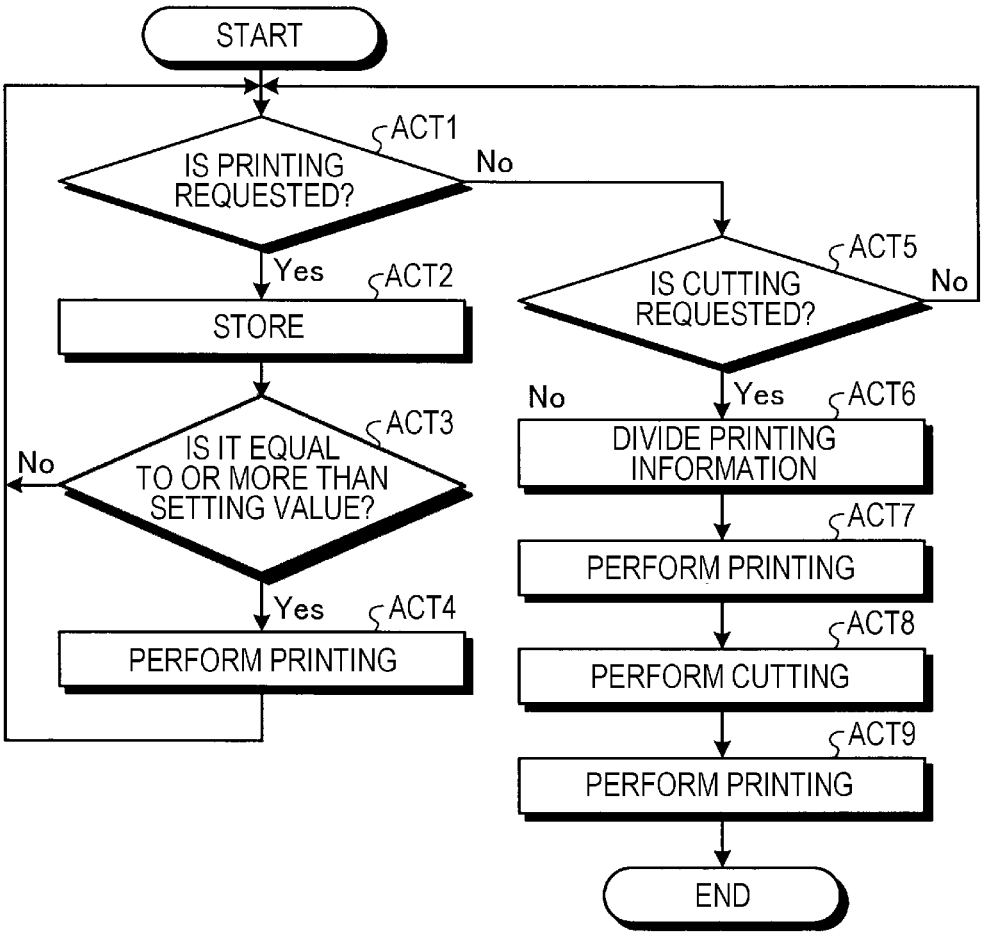
FIG. 7 is a flowchart illustrating an example of a printing process performed by the printer.

Next, the printing process performed by the printer 1 will be described. Here, FIG. 7 is a flowchart illustrating an example of the printing process which is performed by the printer 1 of this embodiment.

The connection control unit 1001 determines whether the print request is received (Act 1). On condition that the print request is received (Act 1; Yes), the job management unit 1005 stores the printing information contained in the received print request in the printing information recording region 110 (Act 2).

The job management unit 1005 determines whether the printing length of the printing information except the printing information firstly stored in the printing information recording region 110 is equal to or more than the setting value (Act 3). On condition that the printing information equal to or more than the setting value is not stored in the printing information recording region 110 (Act 3; No), the printer 1 proceeds to Act 1.

On condition that the printing length of the printing information is equal to or more than the setting value (Act 3; Yes), the printing control unit 1002 prints the firstly stored printing information to the roll paper 2 (Act 4). Then, the printer 1 proceeds to Act 1.

On condition that the print request is not received in Act 1 (Act 1; No), the connection control unit 1001 determines whether the cut request is received (Act 5). On condition that the cut request is not received (Act 5; No), the printer 1 proceeds to Act 1.

On condition that the cut request is received (Act 5; Yes), the printing information dividing unit 1006 divides the printing information stored in the printing information recording region 110 (Act 6).

The printing control unit 1002 prints the printing information on the downstream side in the conveyance direction of the roll paper 2 in the divided printing information (Act 7).

The cutting control unit 1003 cuts the roll paper 2 (Act 8).

The printing control unit 1002 prints the unprinted printing information (Act 9). In other words, the printing control unit 1002 prints the printing information on the upstream side in the conveyance direction of the roll paper 2 in the divided printing information.

With the above process, the printer 1 ends the printing process.

As described above, the printer 1 stores the printing information received from the external device in the printing information recording region 110. Then, if the printing information equal to or more than the setting value is stored in the printing information recording region 110, the printer 1 prints the printing information. In addition, if the cut request of the roll paper 2 is received, the printer 1 prints the printing information of the excess portion while leaving the printing information of the length indicated by the setting value in the printing information stored in the printing information recording region 110. The printer 1 cuts the roll paper 2 on condition that the printing information of the excess portion is printed. In addition, the printer 1 prints the unprinted printing information in the printing information stored in the printing information recording region 110 after cutting the roll paper 2. In this way, the printer 1 performs the printing on the shortened distance from the printing head 11 and the platen roller 12 to the cutting unit 13 after cutting the roll paper 2. Therefore, the printer 1 can print the information printed as the header without causing a contraction even the gap from the printing head 11 to the cutting unit 13 is shortened.

While certain embodiments have been described, these embodiments have been presented by way of example only, and are not intended to limit the scope of the inventions. Indeed, the novel embodiments described herein may be embodied in a variety of other forms; furthermore, various omissions substitutions and changes in the form of the embodiments described herein may be made without departing from the spirit of the inventions. The accompanying claims and their equivalents are intended to cover such embodiments or modifications as would fall within the scope and spirit of the inventions.

In addition, in the above embodiments, the printer 1 and the external device such as the POS terminal are described as separate devices. However, the printer 1 may be assembled to the external device.

In addition, in the above embodiment, the printer 1 has been described as an example when the receipt is printed. However, the printer 1 may also be applied even when a coupon or an advertisement is printed.

The program executed by the devices of the above embodiments or modifications are provided by being incorporated in a storage medium (the ROM or the storage unit) of the devices, but the invention is not limited to this. For example, the program may be configured to be recorded and provided as a file of an installable or executable format which can be read by a computer-readable recording medium such as a CD-ROM, a flexible disk (FD), a CD-R, and a DVD (Digital Versatile Disk). Further, the storage medium is not limited to a medium independent of the computer or the assembled system, but may include a storage medium which downloads a program through a LAN or the Internet, and stores or temporally stores the program.

In addition, the program executed by each device of the above embodiments and the modifications may be stored on a computer connected to a network such as the Internet and downloaded via the network, or may be configured to be provided or distributed via a network such as the Internet.

What is claimed is:

1. A printer, comprising:

a printing head which prints on a roll paper;

a cutting unit, disposed on a downstream side in a conveyance direction of the roll paper from the printing head, and which cuts the roll paper;

a first input unit which sequentially receives an input of printing information to be printed by the printing head;

a storage control unit which sequentially stores the printing information received by the first input unit in a storage medium;

a first printing control unit which causes the printing head to sequentially print the printing information of an excess portion stored in the storage medium while leaving the printing information of a length indicated by a setting value when a cut request of the roll paper is received on condition that a total sum of lengths in the conveyance direction of pieces of the printing information stored in the storage medium is equal to more than the setting value;

a cutting control unit which causes the cutting unit to cut the roll paper on condition that a total sum of lengths in the conveyance direction of the printing information which is stored in the storage medium but not printed is the setting value when the cut request of the roll paper is received; and a second printing control unit which causes the printing head to print the printing information which is stored in the storage medium but not printed on condition that the cutting control unit causes the cutting unit to cut the roll paper.

2. The printer according to claim 1, further comprising:

a dividing unit which divides the printing information stored in the storage medium into a downstream side in the conveyance direction of the roll paper and an upstream side in the conveyance direction by a boundary of the setting value when the cut request of the roll paper is received, wherein the first printing control unit causes the printing head to print the printing information on the downstream side in the conveyance direction divided by the dividing unit, the cutting control unit causes the cutting unit to cut the roll paper on condition that the printing information on the downstream side in the conveyance direction divided by the dividing unit is printed, and the second printing control unit causes the printing head to print the printing information on the upstream side in the conveyance direction divided by the dividing unit on condition that the cutting control unit causes the cutting unit to cut the roll paper.

3. The printer according to claim 2, wherein the first input unit receives the input of the printing information in an element unit of an image which is a printing target of the printing information, wherein the dividing unit divides the printing information in the element unit received by the first input unit, the first printing control unit causes the printing head to print the printing information on the downstream side in the conveyance direction divided by the dividing unit, the cutting control unit causes the cutting unit to cut the roll paper on condition that the printing information on the downstream side in the conveyance direction divided by the dividing unit is printed, and the second printing control unit causes the printing head to print the printing information on the upstream side in the conveyance direction divided by the dividing unit on condition that the cutting control unit causes the cutting unit to cut the roll paper.

4. The printer according to claim 1, further comprising:

a second input unit which receives an input to change a cutting condition on which the cutting control unit causes the cutting unit to cut the roll paper.

5. The printer according to claim 1, further comprising:

a third input unit which receives an input to change the setting value.

6. The printer according to claim 1, wherein the printer is a portable printer.

7. The printer according to claim 1, wherein the printer is comprised in a POS terminal.

8. The printer according to claim 1, wherein the printing head is a thermal head and the printer is a thermal printer.

9. The printer according to claim 1, wherein the printing head is an inkjet head and the printer is an inkjet printer.

10. The printer according to claim 1, wherein the cutting unit comprises a moveable blade and a fixed blade.

11. A method of printing, comprising:

sequentially receiving an input of printing information for printing by a printing head;

sequentially storing the printing information received in a storage medium;

printing sequentially the printing information of an excess portion stored in the storage medium while leaving the printing information of a length indicated by a setting value when a cut request of the roll paper is received on condition that a total sum of lengths in a conveyance direction of pieces of the printing information stored in the storage medium is equal to or more than the setting value;

cutting the roll paper on condition that a total sum of lengths in the conveyance direction of pieces of the printing information which is stored in the storage medium but not printed is the setting value when the cut request of the roll paper is received; and printing the printing information which is stored in the storage medium but not printed on condition that cutting cuts the roll paper.

12. The method according to claim 11, further comprising:

dividing the printing information stored in the storage medium into a downstream side in the conveyance direction of the roll paper and an upstream side in the conveyance direction by a boundary of the setting value when the cut request of the roll paper is received, printing the printing information on the downstream side in the conveyance direction divided by the dividing, cutting the roll paper on condition that the printing information on the downstream side in the conveyance direction divided by the dividing is printed, and printing the printing information on the upstream side in the conveyance direction divided by the dividing on condition that the cutting cuts the roll paper.

13. The method according to claim 12, further comprising:

receiving the input of the printing information in an element unit of an image which is a printing target of the printing information, dividing the printing information in the element unit received, printing the printing information on the downstream side in the conveyance direction divided by the dividing, cutting the roll paper on condition that the printing information on the downstream side in the conveyance direction divided by the dividing is printed, and printing the printing information on the upstream side in the conveyance direction divided by the dividing on condition that the cutting cuts the roll paper.

14. The method according to claim 11, further comprising:

receiving an input to change a cutting condition.

15. The method according to claim 11, further comprising:

receiving an input to change the setting value.

16. The method according to claim 15, further comprising:

receiving an input to change the setting value.

17. The method according to claim 11, wherein printing comprises inkjet printing.

18. The method according to claim 11, wherein printing comprises thermal printing.

19. The method according to claim 11, wherein cutting comprises moving a moveable blade adjacent a fixed blade.

20. A receipt printer, comprising:

a printing head which prints on a roll paper;

a cutting unit, disposed on a downstream side in a conveyance direction of the roll paper from the printing head, and which cuts the roll paper to provide a receipt;

a first input unit which sequentially receives an input of printing information comprising transaction information to be printed by the printing head;

a storage control unit which sequentially stores the printing information received by the first input unit in a storage medium;

a first printing control unit which causes the printing head to sequentially print the printing information of an excess portion stored in the storage medium while leaving the printing information of a length indicated by a setting value when a cut request of the roll paper is received on condition that a total sum of lengths in the conveyance direction of pieces of the printing information stored in the storage medium is equal to more than the setting value;

a cutting control unit which causes the cutting unit to cut the roll paper on condition that a total sum of lengths in the conveyance direction of the printing information which is stored in the storage medium but not printed is the setting value when the cut request of the roll paper is received; and a second printing control unit which causes the printing head to print the printing information which is stored in the storage medium but not printed on condition that the cutting control unit causes the cutting unit to cut the roll paper.

* * * * *